10/20/87 XR 4,701,659

United States Patent [19]

Fujii et al.

[11] Patent Number: 4,701,659

[45] Date of Patent: Oct. 20, 1987

[54] PIEZOELECTRIC ULTRASONIC TRANSDUCER WITH FLEXIBLE ELECTRODES ADHERED USING AN ADHESIVE HAVING ANISOTROPIC ELECTRICAL CONDUCTIVITY

[75] Inventors: Tadashi Fujii; Hiroyuki Yagami, both of Fujinomiya; Iwao Seo; Masahiro Sasaki, both of Ami, all of Japan

[73] Assignees: Terumo Corp.; Mitsubishi Petro. Co., both of Tokyo, Japan

[21] Appl. No.: 777,284

[22] Filed: Sep. 18, 1985

[30] Foreign Application Priority Data

Sep. 26, 1984 [JP] Japan ..... 59-199685
Oct. 27, 1984 [JP] Japan ..... 59-225126

[51] Int. Cl.[4] ..... H01E 41/08

[52] U.S. Cl. ..... 310/334; 310/364; 310/366; 310/800

[58] Field of Search ..... 310/334–337, 310/800, 364, 365, 366, 338, 339, 348

[56] References Cited

U.S. PATENT DOCUMENTS 4,234,813 11/1980 Iguchi ..... 310/339 X
4,281,550 8/1981 Erikson ..... 310/334 X
4,308,482 12/1981 Kajohashi ..... 310/363 X
4,322,652 3/1982 Otsuka ..... 310/363 X
4,328,441 5/1982 Kroeger et al. ..... 310/339 X
4,404,489 9/1983 Larson, III et al. ..... 310/334
4,406,967 9/1983 Obara et al. ..... 310/800 X
4,409,510 10/1983 Assenza et al. ..... 310/334
4,467,237 8/1984 Piaget et al. ..... 310/334
4,473,769 9/1984 Nguyen ..... 310/334
4,479,069 10/1984 Miller ..... 310/334

FOREIGN PATENT DOCUMENTS 1530783 11/1978 United Kingdom ..... 310/334

*Primary Examiner*—Mark O. Budd
*Attorney, Agent, or Firm*—Frishauf, Holtz, Goodman & Woodward

[57] ABSTRACT

An ultrasonic transducer includes a piezoelectric member consisting of either a unpolarized piezoelectric polymer material or the like, or an in-advance polarized piezoelectric polymer material or the like, a first flexible substrate on which a first electrode set and their connecting leads are formed, these being bonded to one surface of the piezoelectric member, and a second flexible substrate on which a second electrode and its connecting lead are formed, these being bonded to the other surface of the piezoelectric member, wherein the piezoelectric member is sandwiched between the first electrode set and second electrode. The electrodes can apply a voltage to polarize the unpolarized piezoelectric polymer material in a manufacturing process of the piezoelectric member, or apply a drive voltage to the finished ultrasonic transducer. Also disclosed is a method of manufacturing the ultrasonic transducer.

8 Claims, 31 Drawing Figures

10
12
14
16
18
20
22
24
26
28
30
32
X
Y 21
10
14
14
18
12
24
22
30
16
16
16
16
28
25
32
XX
XX
YY
YY
7
21
28
10
18
12
30
22
16
16

PIEZOELECTRIC ULTRASONIC TRANSDUCER WITH FLEXIBLE ELECTRODES ADHERED USING AN ADHESIVE HAVING ANISOTROPIC ELECTRICAL CONDUCTIVITY

BACKGROUND OF THE INVENTION

1. Field of the Invention

This invention relates to an ultrasonic transducer and to a method of manufacturing the same.

2. Description of the Prior Art

Ultrasonic transducers are widely employed as the probes in ultrasonic diagnostic equipment for real-time tomography, in ultrasonic materials testing equipment for the non-destructive testing of materials, and in many other applications.

An ultrasonic transducer generally is of a structure that includes a vibrator comprising a piezoelectric element for generating ultrasonic waves conforming to a driving voltage or for converting a received ultrasonic wave into an electric signal, an acoustic matching layer for acoustic impedence matching with a specimen under examination, and a backing member for absorbing both free oscillation of the vibrator and ultrasonic waves that emerge from the back surface, the vibrator, acoustic matching layer and backing being disposed in laminated relation.

Various materials capable of being used as the vibrator of such ultrasonic transducers have been the object of research. One material recently proposed for such use is a film-like piezoelectric polymer member formed from a piezoelectric polymer such as a polyvinylidene fluoride (PVDF) resin. A piezoelectric polymer member such as of PVDF exhibits excellent acoustic matching with respect to a living body since its acoustic impedence is closer to that of a living body than is the acoustic impedence of conventional ceramic piezoelectric members. Such a piezoelectric member also has a low mechanical Q, as a result of which improved sensitivity and response are anticipated, and exhibits flexibility that enables the vibrator to be machined into almost any shape with comparative ease.

To form a vibrator, the piezoelectric member generally is embraced by a pair of electrodes necessary for applying a driving voltage to the piezoelectric member or for detecting a received signal in the form of a voltage, and each electrode must be provided with a lead wire for connecting the electrode to a separately provided transmitter circuit, which supplies the abovementioned driving voltage, or to a separate receiver circuit that receives a signal from the piezoelectric member.

While the above-described prior art has the advantages set forth, problems in manufacture are encountered owing to the fact that a piezoelectric polymer member has little resistance to heat. Specifically, the low heat resistance makes the piezoelectric member susceptible to damage by heat when the lead wires are connected to the electrodes as by soldering. This problem has been an impedement to realizing practical use of a piezoelectric polymer member.

SUMMARY OF THE INVENTION

A first object of the present invention is to provide an ultrasonic transducer having excellent acoustic characteristics, sensitivity and response and capable of being manufactured through a shorter manufacturing process without subjecting a piezoelectric polymer member to the effects of heat.

A second object of the present invention is to provide a method of manufacturing such an ultrasonic transducer.

An ultrasonic transducer according to the present invention comprises a piezoelectric member formed from a piezoelectric polymer material or a piezoelectric polymer composite and having a pair of main surfaces, a first electrode bonded to one of the main surfaces of the piezoelectric member by an adhesive bond so as to substantially cover the one main surface, a second electrode bonded to the other of the main surfaces of the piezoelectric member by an adhesive bond so as to substantially cover the other main surface, a first lead conductor connected to the first electrode for leading the first electrode out to an external terminal, and a second lead conductor connected to the second electrode for leading the second electrode out to an external terminal. The first electrode and the first lead conductor are formed integral with a first flexible substrate, and the second electrode and the second lead conductor are formed integral with the first flexible substrate or with a second flexible substrate. The piezoelectric member is polarized at least by applying a voltage across the first and second electrodes.

In another embodiment of the present invention, the ultrasonic transducer comprises a piezoelectric member formed from a piezoelectric polymer material or a piezoelectric polymer composite and having a pair of main surfaces, a first electrode bonded to one of the main surfaces of the piezoelectric member by an adhesive bond so as to substantially cover the one main surface, a second electrode deposited on the other of the main surfaces of the piezoelectric member so as to substantially cover the other main surface, a first lead conductor connected to the first electrode for leading the first electrode out to an external terminal, and a second lead conductor having an electrode contact portion contacting an edge portion of the second electrode for leading the second electrode out to an external terminal. The first electrode and the first lead conductor are formed integral with a flexible first substrate, the second lead conductor is formed on the first flexible substrate or on a flexible second substrate, the electrode contact portion is brought into intimate pressing contact with the second electrode by bonding the substrate with which the second lead conductor is formed to the second electrode via an adhesive bond, and the piezoelectric member is polarized at least by applying a voltage across the first and second electrodes.

According to another embodiment of the present invention, the first electrode comprises a plurality of electrodes arranged in a side-by-side array, and the second electrode comprises a single electrode arranged to commonly oppose the first electrode. In another embodiment, the first and second electrodes each comprise a plurality of electrodes arranged in a side-by-side array, and the first and second electrodes are arranged to oppose each other in such a manner that the array of the first electrode is oriented perpendicular to the array of the second electrode.

According to a further embodiment of the present invention, the first or second electrode comprises a plurality of electrodes, and the adhesive bond between the electrodes and the piezoelectric member comprises an adhesive possessing anisotropic electrical conductivity.

Further, the flexible substrate on which the second electrode is formed may be provided with an acoustic matching layer.

A method of manufacturing an ultrasonic transducer according to the present invention comprises a conductive pattern formation step of forming a first electrode and a first lead conductor integral with a flexible first substrate on a surface thereof, the first lead conductor extending along the surface of the first substrate starting from a side edge of the first electrode, and forming a second electrode and a second lead conductor integral with the flexible first substrate or a flexible second substrate on a surface thereof, the second lead conductor extending along the surface of the substrate starting from a side edge of the second electrode, a bonding step of bonding the first and second electrodes to opposing first and second main surfaces of a piezoelectric member, which is formed from a piezoelectric polymer material or a piezoelectric polymer composite, by applying an adhesive to a surface of the first electrode and to a surface of the second electrode, and a polarizing step of polarizing the piezoelectric member at least by applying a voltage across the first and second electrodes.

Another embodiment of a method of manufacturing an ultrasonic transducer according to the present invention comprises a conductive pattern formation step of forming a first electrode and a first lead conductor integral with a flexible first substrate on a surface thereof, the first lead conductor extending along the surface of the first substrate starting from a side edge of the first electrode, and forming a second lead conductor having an electrode contact portion at one end thereof on the flexible first substrate or a flexible second substrate, a second electrode formation step of depositing a second electrode on a first main surface of a piezoelectric member formed from a piezoelectric polymer material or a piezoelectric polymer composite, a bonding step of bonding the first electrode to a second main surface of the piezoelectric member by applying an adhesive to a surface of the first electrode, and bonding the electrode contact portion to an edge portion of the second electrode by applying an adhesive to a surface of the substrate adjacent the electrode contact portion, and a polarizing step of polarizing the piezoelectric member at least by applying a voltage across the first and second electrodes.

According to still another embodiment of the present invention, an ultrasonic transducer comprises a piezoelectric member formed from a piezoelectric polymer material or a piezoelectric polymer composite and having a pair of main surfaces, the piezoelectric member being polarized in advance, a first electrode bonded to one of the main surfaces of the piezoelectric member by an adhesive bond so as to substantially cover the one main surface, a second electrode bonded to the other of the main surfaces of the piezoelectric member by an adhesive bond so as to substantially cover the other main surface, a first lead conductor connected to the first electrode for leading the first electrode out to an external terminal, and a second lead conductor connected to the second electrode for leading the second electrode out to an external terminal. The first electrode and the first lead conductor are integrally formed with a flexible first substrate, and the second electrode and the second lead conductor are integrally formed with the flexible first substrate or a flexible second substrate.

According to a further embodiment of the present invention, an ultrasonic transducer comprises a piezoelectric member formed from a piezoelectric polymer material or a piezoelectric polymer composite and having a pair of main surfaces, the piezoelectric member being polarized in advance, a first electrode bonded to one of the main surfaces of the piezoelectric member by an adhesive bond so as to substantially cover the one main surface, a second electrode deposited on the other of the main surfaces of the piezoelectric member so as to substantially cover the other main surface, a first lead conductor connected to the first electrode for leading the first electrode out to an external terminal, and a second lead conductor having an electrode contact portion contacting an edge portion of the second electrode for leading the second electrode out to an external terminal. The first electrode and the first lead conductor are integrally formed with a flexible first substrate, and the second lead conductor is formed on the flexible first substrate or a flexible second substrate. The flexible substrate is bonded to the second electrode by an adhesive bond, whereby the electrode contact portion is brought into intimate pressing contact with the second electrode.

According to another embodiment of the present invention, the first electrode comprises a plurality of electrodes arranged in a side-by-side array, and the second electrode comprises a single electrode arranged to commonly oppose the first electrode. In another embodiment, the first and second electrodes each comprise a plurality of electrodes arranged in a side-by-side array, and the first and second electrodes are arranged to oppose each other in such a manner that the array of the first electrode is oriented perpendicular to the array of the second electrode.

According to a further embodiment of the present invention, the first or second electrode comprises a plurality of electrodes, and the adhesive bond between the electrodes and the piezoelectric member comprises an adhesive possessing anisotropic electrical conductivity.

Further, the flexible substrate on which the second electrode is formed may be provided with an acoustic matching layer.

A method of manufacturing an ultrasonic transducer according to yet another embodiment of the present invention comprises a conductive pattern formation step of forming a first electrode and a first lead conductor integral with a flexible first substrate on a surface thereof, the first lead conductor extending along the surface of the first substrate starting from a side edge of the first electrode, and forming a second lead conductor having an electrode contact portion at one end thereof on the flexible first substrate or a flexible second substrate, a second electrode formation step of depositing a second electrode on a first main surface of a piezoelectric member formed from a piezoelectric polymer material or a piezoelectric polymer composite, a polarizing step of arranging a conductive plate so as to cover a second main surface of the piezoelectric member and polarizing the piezoelectric member at least by applying a predetermined voltage across the the conductor plate and the second electrode, and a bonding step of bonding the first electrode to a second main surface of the piezoelectric member by applying an adhesive to a surface of the first electrode, and bonding the electrode contact portion to an edge portion of the second electrode by applying an adhesive to a surface of the flexible substrate adjacent the electrode contact portion.

A method of manufacturing an ultrasonic transducer according to another embodiment of the present invention comprises a polarizing step of arranging first and second conductive plates so as to cover opposing first and second main surfaces of a piezoelectric member formed from a piezoelectric polymer material or a piezoelectric polymer composite, and polarizing the piezoelectric member at least by applying a predetermined voltage across the first and second conductor plates, a conductive pattern formation step of forming a first electrode and a first lead conductor integral with a flexible first substrate on a surface thereof, the first lead conductor extending along the surface of the first substrate starting from a side edge of the first electrode, and forming a second electrode and a second lead conductor integral with the first flexible substrate or a flexible second substrate on a surface thereof, the second lead conductor extending along the surface of the substrate starting from a side edge of the second electrode, and a bonding step of bonding the first and second electrodes to the opposing first and second main surfaces of the piezoelectric member by applying an adhesive to a surface of the first electrode and to a surface of the second electrode.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

An ultrasonic transducer according to the present invention and a method of manufacturing the same in accordance with the invention will now be described with reference to the accompanying drawings.

Figures 1A, 1B:
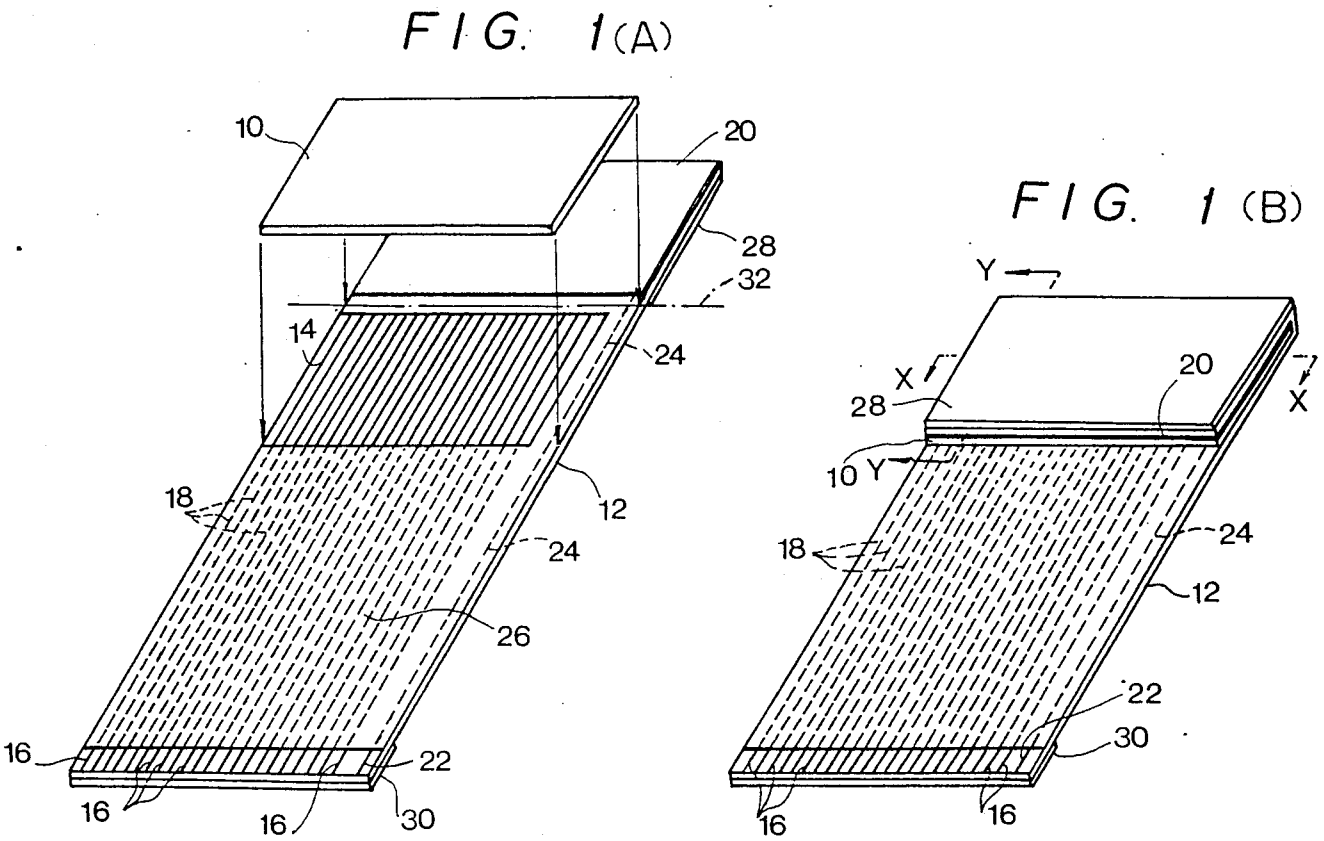
FIGS. 1(A)–1(C) are perspective views illustrating a process for manufacturing a first embodiment of an ultrasonic transducer according to the present invention.
Figure 1:
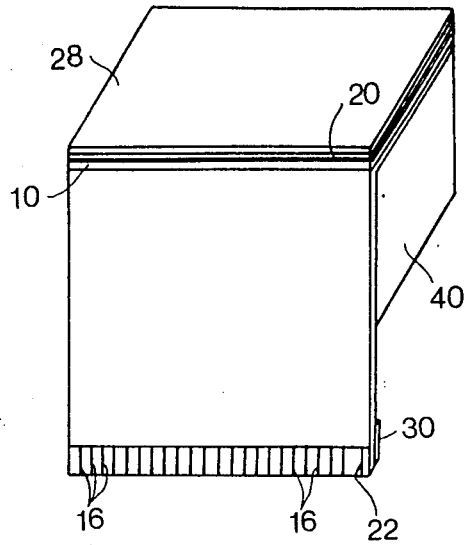

First, an embodiment in which the present invention is applied to a so-called linear array probe will be described in line with a process, shown in FIGS. 1(A)–1(C), for manufacturing the probe. As shown in FIG. 1(A), a piezoelectric member 10 consisting of a piezoelectric polymer material has the form of a flat plate which, in the state shown, is as yet unpolarized. An embodiment in which the piezoelectric member 10 is polarized in advance will be described in detail later in the specification. The piezoelectric polymer material may comprise polyvinyl fluoride, polyvinylidene fluoride, vinylidene fluoride—vinyl fluoride copolymer, vinylidene fluoride—ethylene trifluoride copolymer, vinylidene fluoride—ethylene tetrafluoride copolymer, vinylidene cyanide—vinyl acetate copolymer, vinylidene cyanide—acrylnitrile copolymer, vinylidene cyanide—vinylidene chloride copolymer, vinylidene cyanide—styrene copolymer, vinylidene cyanide—methyl methacrylate copolymer, vinylidene cyanide—methyl chloro acrylate copolymer, vinylidene cyanide—vinyl benzonate copolymer, vinylidene cyanide—vinyl chloro acetate copolymer, vinylidene cyanide—vinyl chloride copopymer, vinylidene cyanide—acryl acid copolymer, vinylidene cyanide—2.5-di chloro styrene copolymer, vinylidene cyanide—2 chloro-1.3-butadiene copolymer, polyvinylidene cyanide, polyacrylnitrile, polyvinyl chloride and the like in molded form, a uniaxially or biaxially stretched material, or a composite obtained by kneading finely divided powder of a strongly dielectric ceramic such as lead zirconate titanate with a polymeric material such as polyvinylidene fluoride, polyvinyl fluoride, nylon, polyacetal or polyacrylnitrile.

A substrate 12 consists of a flexible insulating material, such as polyimide or polyester, which is molded into the form of a film. Formed integral with the substrate 12 on the upper surface thereof in the form of conductive patterns comprising copper foil or the like are an electrode array 14, a plurality of lead conductors 18, a common electrode 20, and a single lead conductor 24. The electrode array 14, which serves as a first electrode, comprises a plurality of strip-like electrodes arranged side by side to form an array. Each of the lead conductors 18 has one end connected to a corresponding electrode in the electrode array 14, and has its other end drawn out to one transverse edge of the substrate 12 to form an external terminal 16. The common electrode 20, which serves as a second electrode, is disposed adjoining the electrode array 14 but spaced a prescribed distance therefrom on a region axially symmetric (line 32 serving as the reference) with respect to the region on which the electrode array 14 is formed. The lead conductor 24 has one end connected to the common electrode 20, and has its other end drawn out to the one transverse edge of the substrate 12 to form an external terminal 22. One method of forming these conductor patterns on the substrate 12 would be to bond a conductive foil, such as the abovementioned copper foil, to the entire surface of the substrate 12 by means of an adhesive, and then etch away the foil at the prescribed areas as by photoetching to form the desired patterns. Other well-known methods capable of being applied are vapor deposition and printing. Next, a coating of an insulative film 26 or the like is applied to the surface of the substrate with the exception of the regions occupied by the electrode array 14, common electrode 20 and terminals 16, 22. An acoustic matching layer 28 is then formed on the underside of the substrate 12 on the portion thereof underlying the common electrode 20. Also provided on the underside of substrate 12 beneath the terminals 16, 22 is a reinforcing strip 30.

Next, an adhesive is applied to the electrode array 14, the common electrode 20, and to the upper surface of substrate 12 at the portion thereof corresponding to the piezoelectric member 10. As shown in FIG. 1(B), the piezoelectric member 10 is placed upon the electrode array 14 and the substrate 12 is folded upwardly about the line of symmetry 32 to bring the common electrode 20 into intimate contact with the upper surface of the piezoelectric member 10. A predetermined amount of pressure accompanied by heating to a prescribed temperature is now applied across the acoustic matching layer 28 and the portion of substrate 12 underlying the electrode array 14 to set the adhesive. This bonds the piezoelectric member 10 between the electrode array 14 and the common electrode 20. As shown in the sectional views of FIGS. 2(A), 2(B), which are taken along the lines X—X, Y—Y, respectively, of FIG. 1(B), an adhesive bond 34 is formed between the piezoelectric member 10 and the electrode array 14, and an adhesive bond 36 is formed between the piezoelectric member 10 and the common electrode 20.

Figure 2:
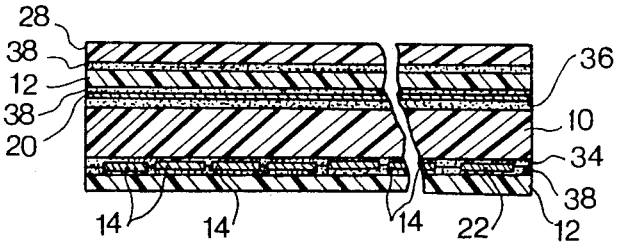
FIGS. 2(A), 2(B) are enlarged sectional views taken along lines X—X, Y—Y, respectively, of FIG. 1(B)
Figure 2:
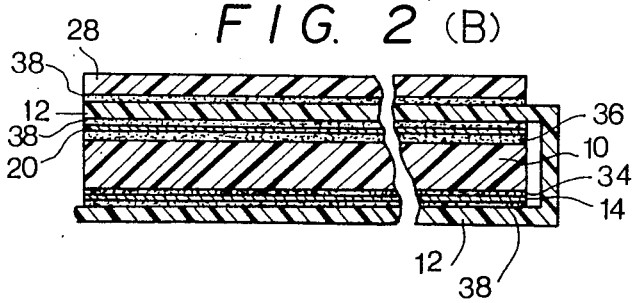

The adhesive bonds 34, 36 should be formly thinly in order to assure good electrical conductivity. Using an electrically conductive adhesive to form the bonds is especially preferred, though the type of conductivity possessed by the adhesive in such case is required to be anisotropic because the strip-like electrodes constituting the electrode array 14 must be insulated from one another. Thus, the bond 34 may be such as exhibits anisotropic conductivity for electrically connecting the electrode array 14 and the main surface of the piezoelectric member 10 while at the same time insulating the strip-like electrodes of the electrode array 14 from one another. In other words, the bond 34 exhibits conductivity in the thickness direction and an insulative property at right angles to the thickness direction. The temperature applied to set the adhesive is 10° to 180° C., preferably 80° to 150° C., the pressure applied is 5 to 80 kg/cm$^2$, preferably 10 to 50 kg/cm$^2$, and the temperature and pressure are applied over a period of time ranging from 1 sec to 10 min, preferably 2 to 30 sec. In FIGS. 2(A), 2(B), the numerals 38 designate adhesive bonds that bond the electrode array 14, the common electrode 20, the lead conductors 16, 18, 22, 24 and the acoustic matching layer 28 to the substrate 12.

After the configuration shown in FIG. 1(B) is attained, a voltage is impressed across the electrode array 14 and common electrode 20 via the external terminals 16, 22 to polarize the piezoelectric member 10. Though the polarizing conditions differ depending upon the type of piezoelectric member, exemplary conditions are a temperature of 10° to 180° C., preferably 40° to 175° C., an electric field strength ranging from 50 kV/cm up to the insulation breakdown strength, preferably 100 kV/cm to 2000 kV/cm, and an application time of 10 sec to 10 hr, preferably 10 min to 2 hr. Further, it is essential that the distance from the electrode array 14 to the external terminal 16 and from the common electrode 20 to the terminal 22 be so designed as to avoid the occurrence of creepage discharge when the polarizing voltage is applied.

When the polarization of piezoelectric member 10 is completed, a backing 40 is bonded to the side of substrate 12 underlying the electrode array 14, after which the portion of the substrate 12 carrying the first lead conductors 18 is folded onto the side face of the backing 40. The result is a completed ultrasonic transducer.

According to the first embodiment of the present invention as set forth above, the electrode array 14, the common electrode 20 and the lead conductors 18, 24 connected to these electrodes are formed integral with the same flexible substrate. Thereafter, these electrodes are bonded to the piezoelectric member 10 by an adhesive to form a vibrator body. Such a structure and method of manufacture eliminate the need to solder the lead conductors to the electrodes and make it possible to produce the vibrator without subjecting the piezoelectric polymer member to damage caused by heat.

Further, since the electrodes and lead conductors can be substantially connected and the piezoelectric member can be formed while being substantially divided into a plurality of array vibrators in a single manufacturing step, the overall manufacturing process is shortened.

According to the first embodiment of the present invention, the electrode array 14 comprising the strip-like electrodes arrayed in side-by-side manner and the common electrode 20 opposing the electrode array 14 are bonded to the piezoelectric member 10, after which the piezoelectric member 10 is polarized via the electrode array 14 and common electrode 20. This not only eliminates the need for a prior-art manufacturing step in which the electrode array pattern pitch of the piezoelectric member and the array pattern pitch on the substrate are brought into precise agreement, but also enables an array pattern having a high density to be formed with a high degree of accuracy.

Further, in the above embodiment, the acoustic matching layer 28 is provided on and integrated with the substrate 12, on which the electrodes are formed in advance. Accordingly, the acoustic matching layer 28 can be formed at a predetermined position at the same time as the step for forming the electrodes and lead conductors is performed.

Thus, the first embodiment of the present invention not only shortens the manufacturing process to lower costs but also provides a highly precise, high-density array-type ultrasonic transducer having excellent acoustic characteristics, sensitivity and response.

More specifically, since the ultrasonic transducer obtained features an acoustic matching layer and adhesive bonds of highly uniform thickness, the characteristics (sensitivity and pulse response) of the individual array vibrators are uniform, so that a uniform ultrasonic tomograph can be produced over a wide field of view. Moreover, the fact that the overall transducer is flexible makes it possible to freely deform the shape of the transducer. Thus, the transducer is applicable not only to linear array probes but also to probes of the arc array and convex array type. Accordingly, a transducer according to the above embodiment of the present invention can be widely applied to various methods of ultrasonic tomography and to the diagnosis of various regions of a living body.

A second embodiment in which the present invention is applied to a linear array probe will be described in line with a process, shown in FIGS. 3(A)–3(C), for manufacturing the probe. Unlike the embodiment of FIGS. 1(A)-1(C), the density of the electrode array 14 is increased twofold. To achieve this, the lead conductors 18, which are formed integral with respective ones of the strip-like electrodes of the electrode array 14, are extended alternately to both transverse edges of the substrate 12 on either side of the electrode array 14 to form two sets of the external terminals 16, one on each transverse edge, thus assuring that a sufficient spacing is provided between mutually adjacent ones of the terminals 16 on each edge. The common electrode 20 in this embodiment is formed on a substrate 13 formed projecting from the side surface of the electrode array 14. The structure and manufacturing method of the ultrasonic transducer of this embodiment are identical with those of the embodiment shown in FIGS. 1(A)-1(C) in all other respects; hence, identical parts are designated by like reference numerals and are not described again.

Figure 3:
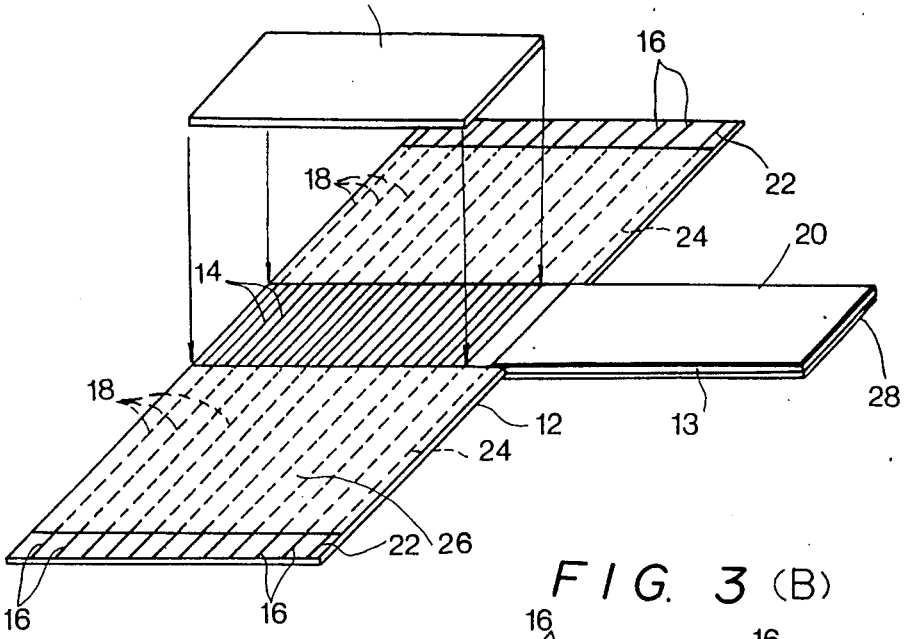
FIGS. 3(A)–3(C) are perspective views illustrating a process for manufacturing a second embodiment of an ultrasonic transducer according to the present invention.
Figure 3:
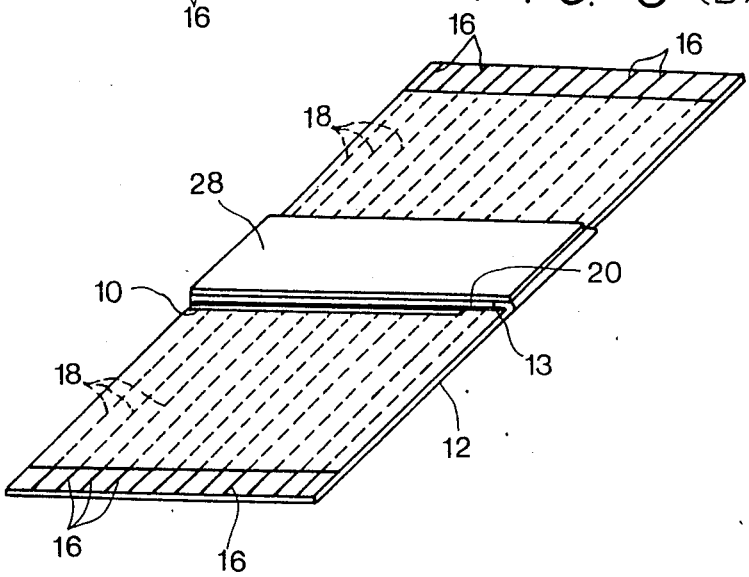
Figure 3:
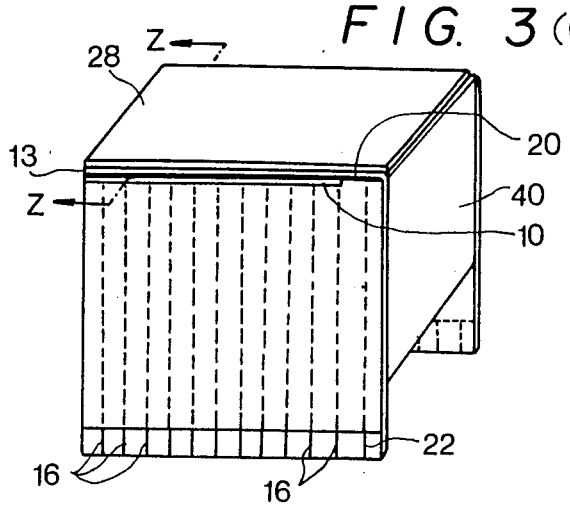
Figure 4:
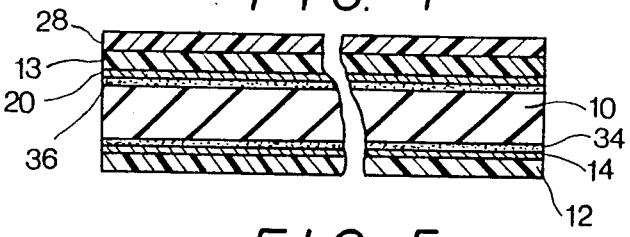
FIG. 4(A) is an enlarged sectional view taken along lines Z—Z of FIG. 3(C)
Figure 5:
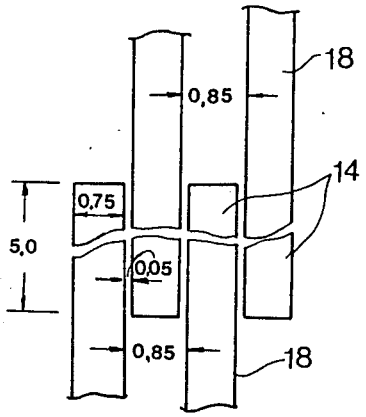
FIG. 5 is a partially enlarged view illustrating the embodiment of FIGS. 3(A)–3(C)

FIG. 4 is a sectional view taken along line Z—Z of FIG. 3(C), and FIG. 5 is an enlarged view showing one example of the arrangement of the electrode array 14 and lead conductors 18. As shown in FIG. 5, each strip-like electrode of the electrode array 14 has a width of 0.75 mm and a length of 5.0 mm. The spacing between mutually adjacent strip-like electrodes is 0.05 mm.

The embodiment of FIGS. 3(A)-3(C) thus provides an ultrasonic transducer that possesses the advantages of the first embodiment in addition to a higher electrode array density.

A third embodiment in which the present invention is applied to a linear array probe will be described in line with a process, shown in FIGS. 6(A)-6(C), for manufacturing the probe. Unlike the embodiment of FIGS. 1(A)-1(C), the common electrode 20 is not formed on the substrate 12; instead, a common electrode 21 is formed over the entirety of the main surface of piezoelectric member 10 as by vapor deposition of silver or aluminum, and an electrode contact portion 25 of predetermined width is formed integral with the lead conductor 24 on a position of the substrate 12 that will contact a marginal edge portion of the common electrode 21 when the portion of the substrate 12 provided with the acoustic matching layer 28 is folded onto and bonded to the upper surface of the common electrode 21. As shown in the sectional views of FIGS. 7(A), 7(B), which are taken along the lines XX—XX, YY—YY, respectively, of FIG. 6(B), the electrode contact portion 25 is held in intimate pressing contact with the upper surface of the marginal edge portion of common electrode 21 by the adhesive bond 38, thereby effecting an electrical connection between the contact portion 25 and the common electrode 21. The structure and manufacturing method of the ultrasonic transducer of this embodiment are identical with those of the embodiment shown in FIGS. 1(A)-1(C) in all other respects; hence, identical parts are designated by like reference numerals and are not described again.

Figures 6A, 6B:
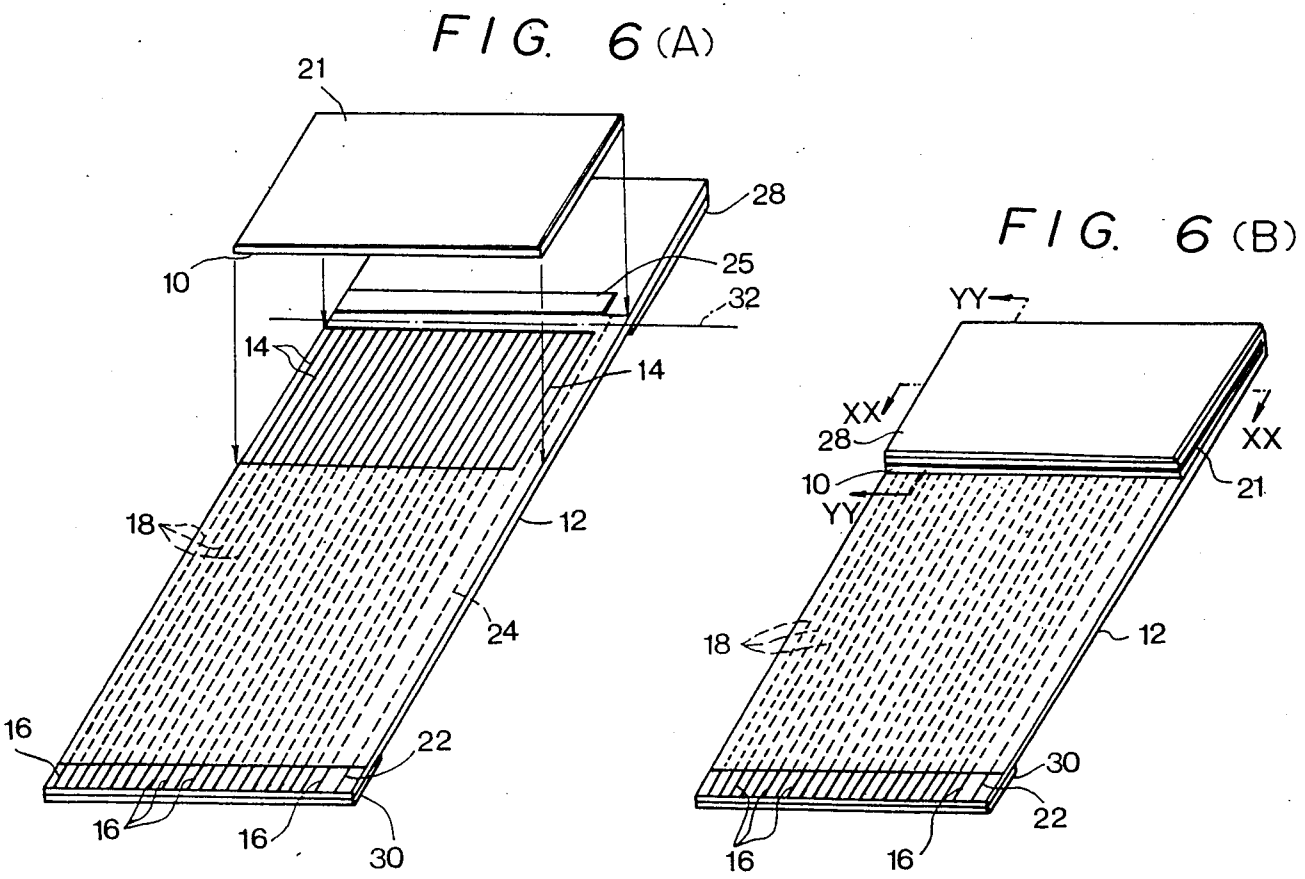
FIGS. 6(A)–6(C) are perspective views illustrating a process for manufacturing a third embodiment of an ultrasonic transducer according to the present invention.
Figure 6:
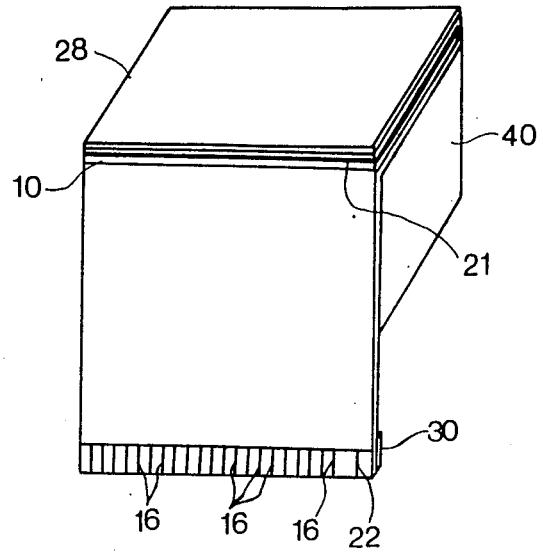
Figure 7:
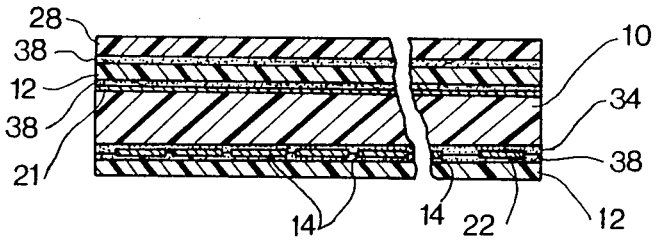
FIGS. 7(A), 7(B) are enlarged sectional views taken along lines XX—XX, YY—YY, respectively, of FIG. 6(B)
Figure 7:
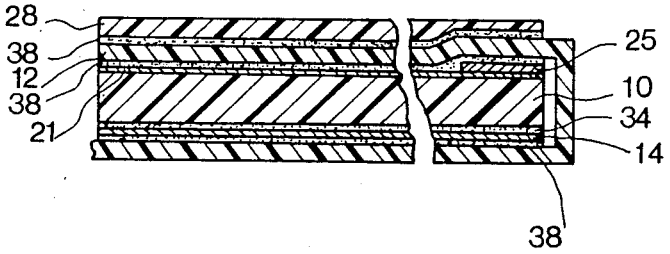

Thus, the embodiment of FIGS. 6(A)-6(C) provides an ultrasonic transducer having advantages that supplement those of the first embodiment. Specifically, the electrode contact portion (corresponding to the common electrode 20 of FIGS. 1(A)), which is formed from a material such as copper foil having a high acoustic impedence, is extremely thin, the common electrode 21 is provided on the ultrasonic wave emitting side of the transducer, impedence mismatch between a medium and the vibrator can be diminished, an adverse influence upon the transmission of sent and received waveforms can be reduced.

Figure 8A:
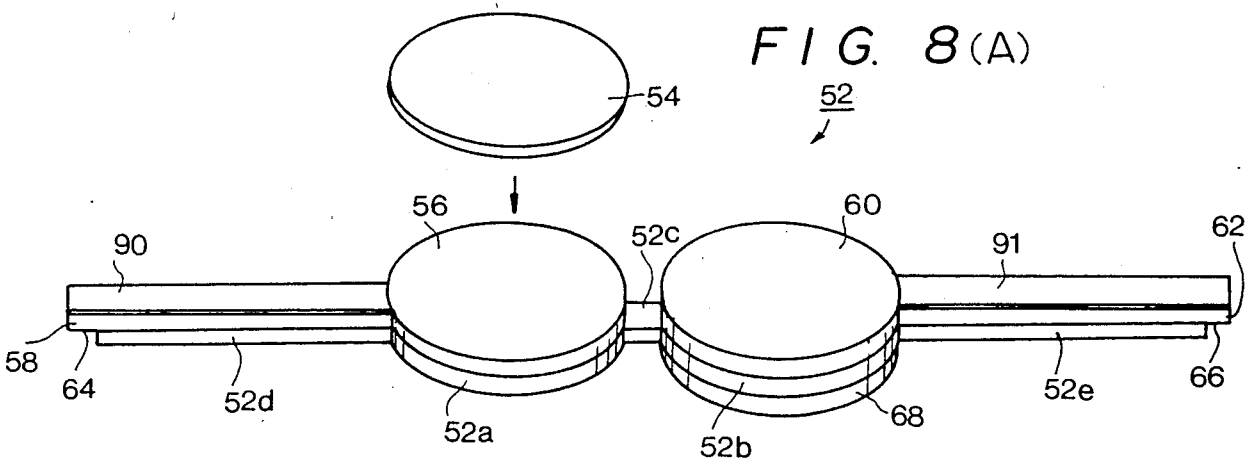
FIGS. 8(A)–8(D) are perspective views illustrating a process for manufacturing a fourth embodiment of an ultrasonic transducer according to the present invention.
Figure 8B:
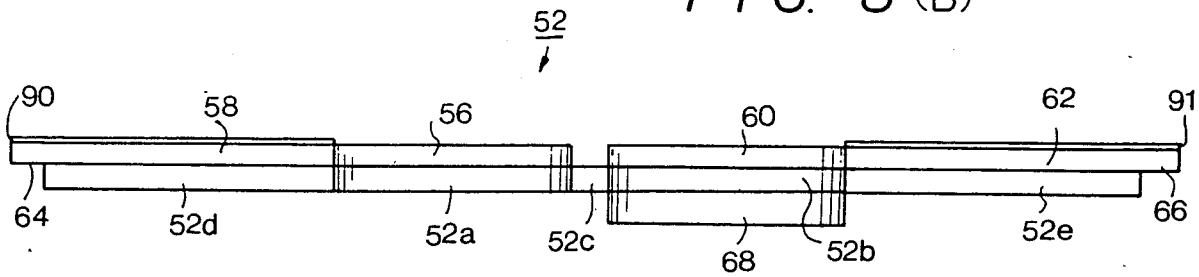
Figure 8:
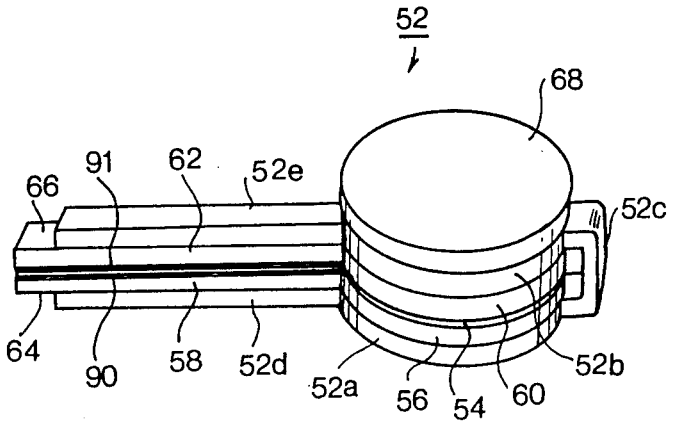
Figure 8:
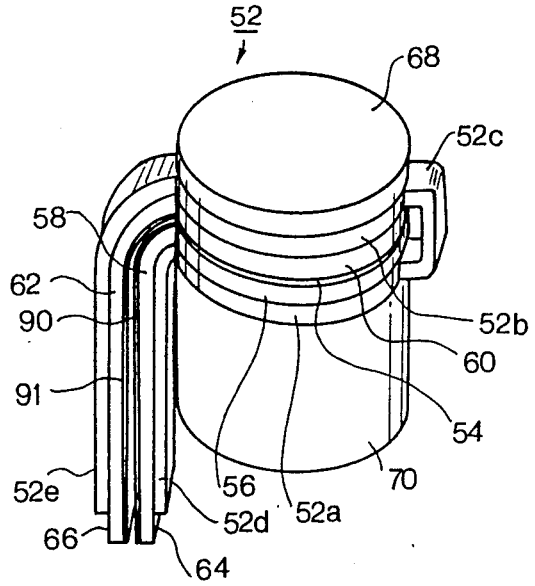

A fourth embodiment of the present invention shown in FIGS. 8(A) through 8(D) relates to a manufacturing procedure for forming a circular probe 50. Here a flexible substrate 52 includes two circular portions 52*a*, 52*b* corresponding to a circular piezoelectric polymer member 54, a folding portion 52*c* linking the two circular portions 52*a*, 52*b*, a lead conductor support portion 52*d* extending from the circular portion 52*a*, and a lead conductor support portion 52*e* extending from the circular portion 52*b*. An integrally formed first electrode 56 and first lead conductor 58, coated with an insulator 90 (see FIG. 8(B)), are bonded via an adhesive bond to the substrate surface of circular portion 52*a* and lead conductor support portion 52*d*, respectively, of substrate 52. Similarly, an integrally formed second electrode 60 and second lead conductor 60, coated with an insulator 91, are bonded via an adhesive bond to the substrate surface of circular portion 52*b* and lead conductor support portion 52*e*, respectively, of substrate 52. The distal end portions of the first and second lead conductors 58, 62 serve as external terminals 64, 66, respectively since the distal end portions of the substrates 52*d* and 52*e* are cut off, and an acoustic matching layer 68 is provided on the underside of circular portion 52*b* underlying the second electrode 60. Next, a coating of an electrically conductive adhesive is applied to the electrode surfaces of the first and second electrodes 56, 60. Then, as shown in FIG. 8(C), the substrate 52 is folded at the portion 52*c* to bring the first and second electrodes 56, 60 into contact with and to bond them to the piezoelectric member 54 from either side thereof. The bonding conditions and subsequent polarizing treatment are as set forth earlier with regard to the embodiment of FIGS. 1(A)-1(C). The vibrator body formed in this manner is provided with a backing member 70 bonded thereto, as shown in FIG. 8(D).

The embodiment of FIGS. 8(A)-8(D) has the same advantages as the embodiment of FIGS. 1(A)-1(C).

Figure 9:
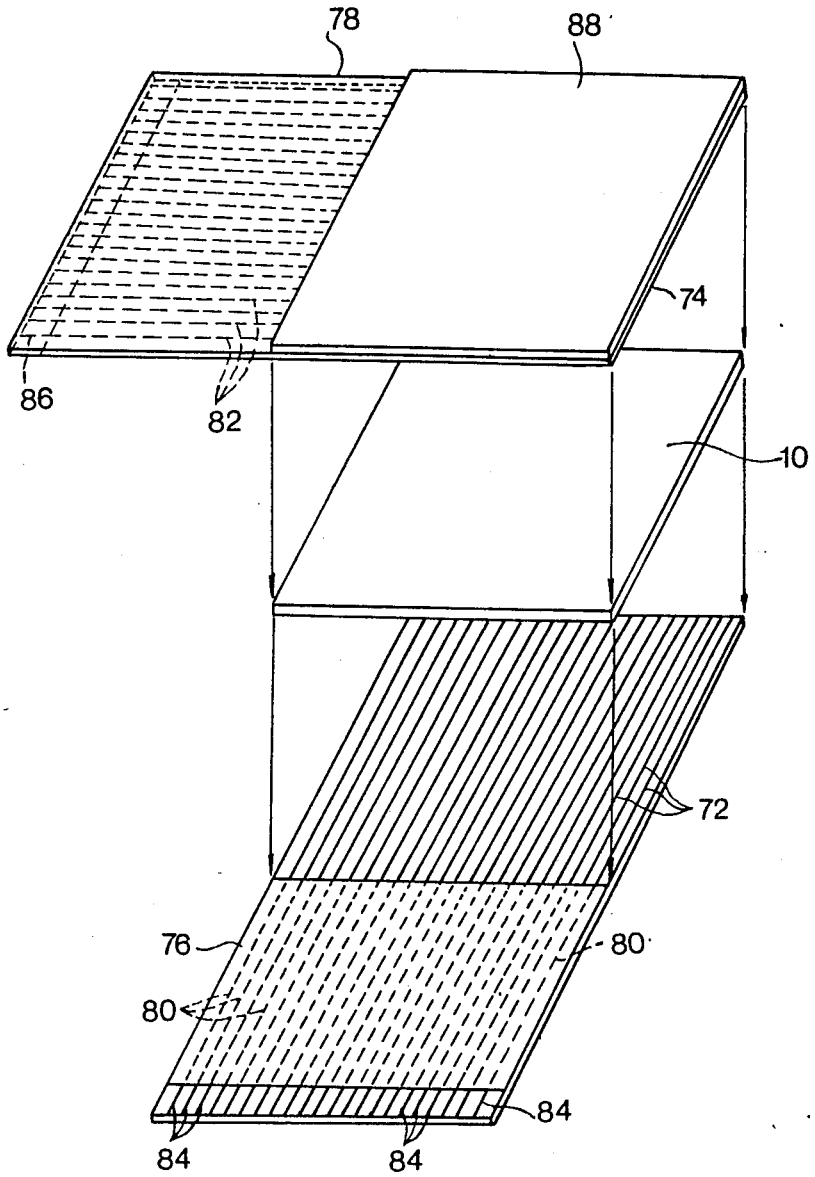
FIG. 9 is a perspective view illustrating one part of a process for manufacturing a fifth embodiment of an ultrasonic transducer according to the present invention.

FIG. 9 shows a portion of a manufacturing process of a fifth embodiment in which the present invention is applied to a two-dimensional matrix array probe. Unlike the embodiment of FIGS. 1(A)-(C), first and second electrodes are provided in the form of electrode arrays 72, 74, which are formed integral with respective first and second lead conductors 80, 82 on separate flexible substrates 76, 78, respectively, and the electrode arrays 72, 74 are bonded to the piezoelectric member 10 in such a manner that the array directions are perpendicular to each other. Numerals 84, 86 denote the external terminals of the electrode arrays 72, 74, respectively, and numeral 88 denotes an acoustic matching layer provided on the substrate 74 over the electrode array 74.

The other steps of the manufacturing process are similar to those of the first embodiment and need not be described again. Further, it is possible for the substrates 76, 78 to be integrated, which would greatly facilitate electrode formation and external connections for a complicated matrix array.

The fifth embodiment described above has the same advantages as the embodiment of FIGS. 1(A)-1(C).

Figure 10:
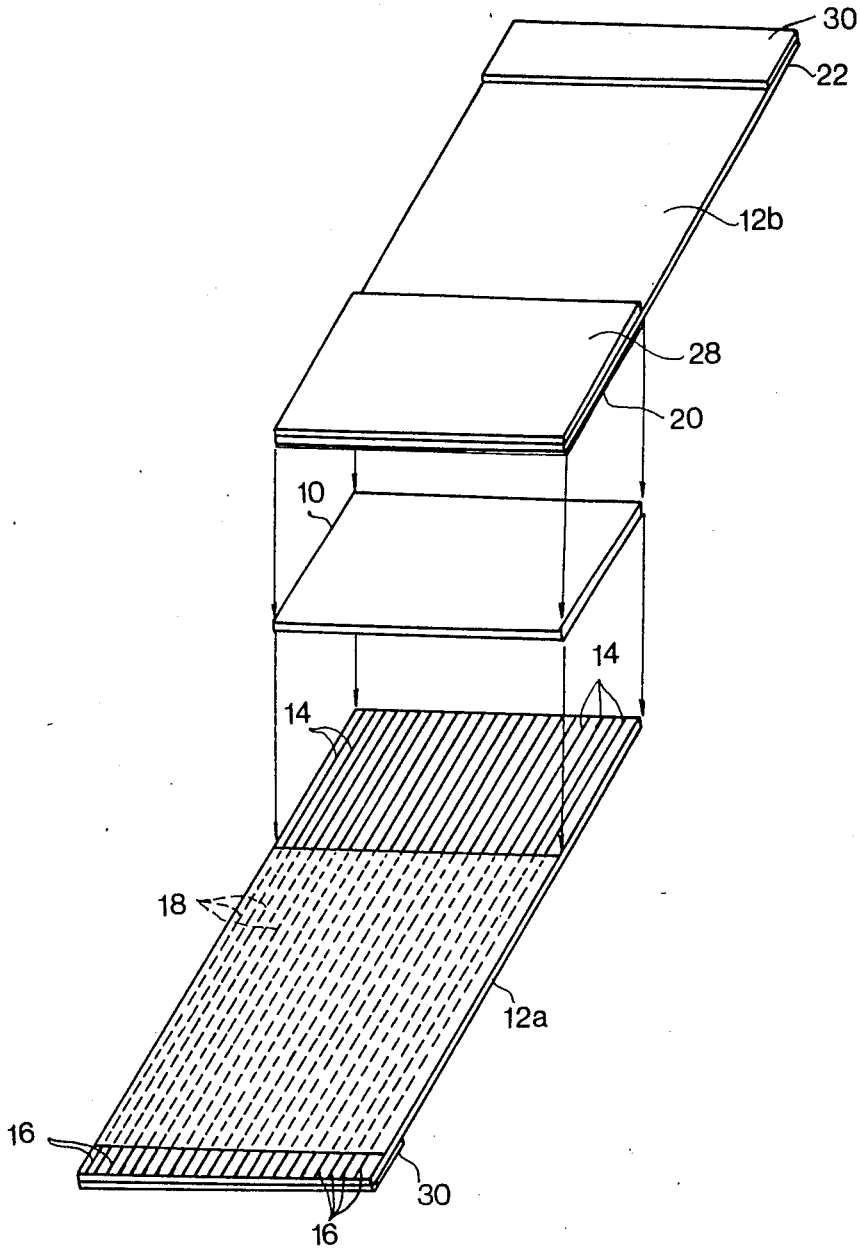
FIGS. 10(A)–10(C) are perspective views illustrating a process for manufacturing an ultrasonic transducer according to the present invention, this being a modification of the embodiment shown in FIG. 1.
Figure 10:
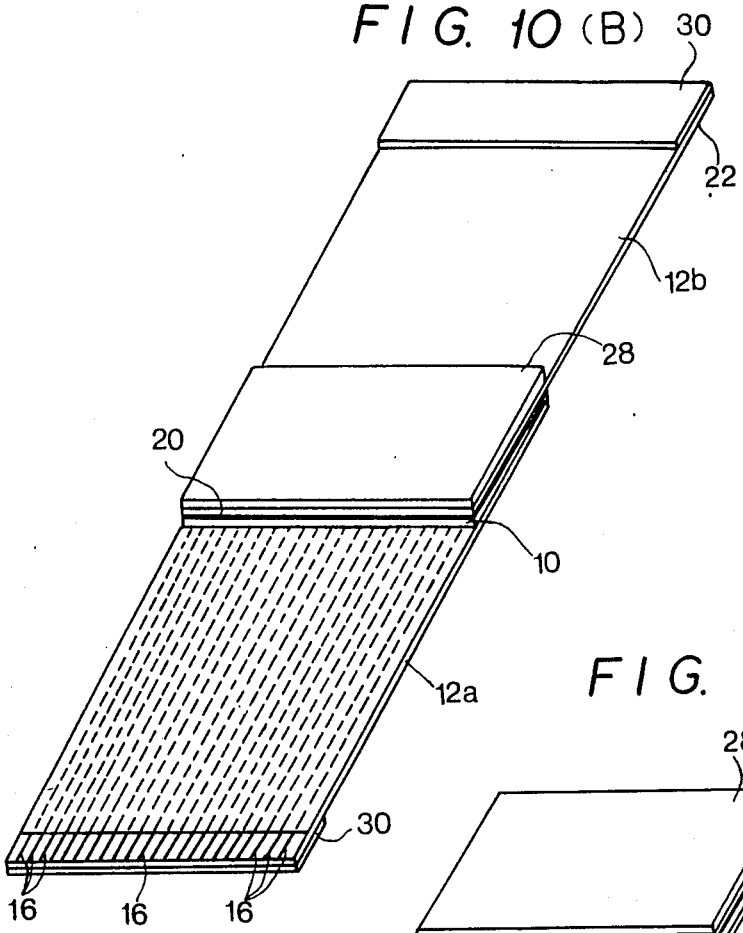
Figure 10:
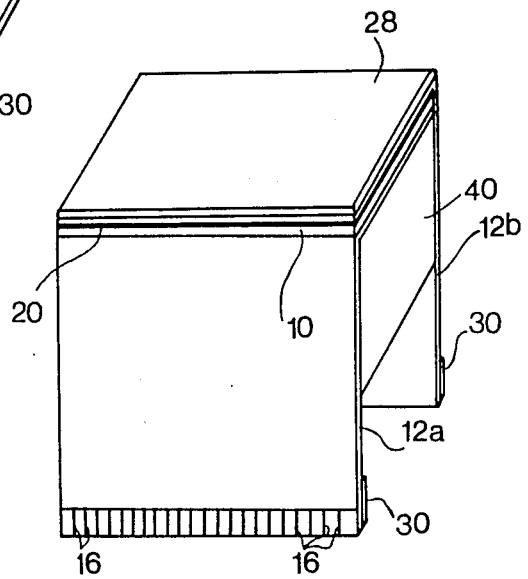

FIGS. 10(A)-10(C) show a modification of the embodiment illustrated in FIGS. 1(A)-1(C). This arrangement differs from that of FIGS. 1(A)-1(C) in that the flexible substrate is divided into a substrate 12*a* for the electrode array 14 and a substrate 12*b* for the common electrode 20.

In the embodiments of the invention described hereinabove, the piezoelectric member 10 is subjected to a polarization treatment after being fabricated. Described hereinafter with reference to FIGS. 11(A)–11(D) and 12(A)–12(D) will be embodiments in which a piezoelectric blank is polarized in advance and then fabricated into the final piezoelectric member 10.

Figure 11A:
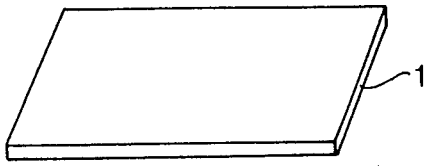
FIGS. 11(A)–11(D) and 12(A)–12(D) are perspective views illustrating a polarizing treatment process carried out when a piezoelectric member is to be polarized in advance.
Figure 11B:
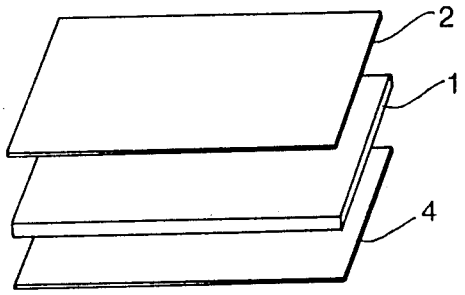
Figure 11C:
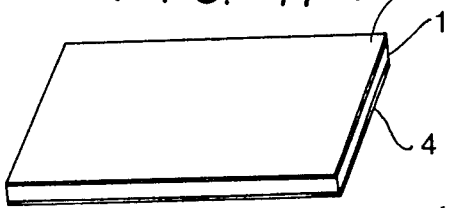
Figure 11D:
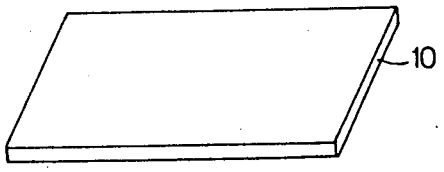
Figure 12:
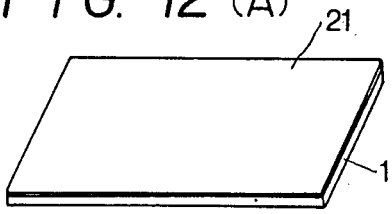
Figure 12:
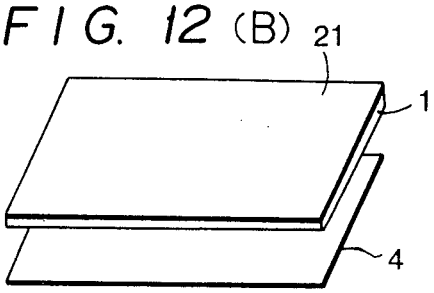
Figure 12:
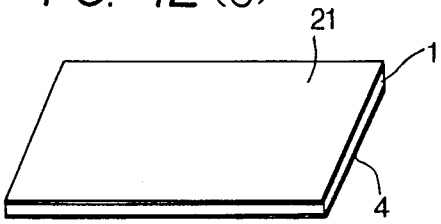
Figure 12:
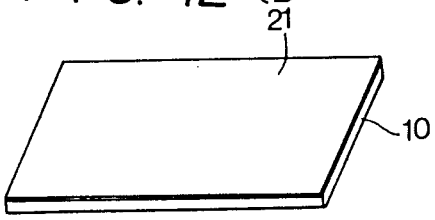

The process shown in FIGS. 11(A)–11(D) is for fabricating the piezoelectric member 10 of FIGS. 1(A)–1(D) from an unpolarized piezoelectric blank 1. Specifically, the unpolarized piezoelectric blank 1 is formed into a flat plate of the type shown in FIG. 11(A), in which state the blank 1 is as yet unpolarized. The piezoelectric blank 1 has a pair of opposing main surfaces, which are the upper and lower surfaces as seen in the drawings Next, as illustrated in FIG. 11(B), conductive plates (as of copper) 2, 4 are formed on the blank 1 so as to cover the main surfaces, the conductive plates 2, 4 are arranged to sandwich the piezoelectric blank 1 therebetween, as depicted in FIG. 11(C), and a voltage is impressed across the conductive plates 2, 4 to polarize the piezoelectric blank 1. Though the polarizing conditions differ depending upon the type of piezoelectric member, exemplary conditions are a temperature of 10° to 180° C., preferably 40° to 175° C., an electric field strength ranging from 50 kV/cm up to the insulation breakdown strength, preferably 100 kV/cm to 2000 kV/cm, and an application time of 10 sec to 10 hr, preferably 10 min to 2 hr. The result is the polarized piezoelectric member 10, shown in FIG. 11(D).

After the prepolarized vibrator body is thus formed, the backing 40 is bonded to the substrate 12 on the portion underlying the electrode array 14, and the portion of the substrate 12 having the first lead conductors is folded onto the side surface of the backing 40 to form the ultrasonic transducer, as shown in FIG. 1(C).

The process shown in FIGS. 12(A)–12(D) is for fabricating the piezoelectric member 10 of FIGS. 6(A)–6(D) from the unpolarized piezoelectric blank 1. Unlike the arrangement of FIGS. 11(A)–11(D), the conductive plate 2 is unnecessary since the common electrode 21 is formed by a method such as vapor deposition. The structure and manufacturing method are identical with those of the embodiment shown in FIGS. 1(A)–1(C) in all other respects; hence, identical parts are designated by like reference numerals and are not described again.

According to the embodiment abovementioned, the piezoelectric member 10 can be obtained in a large size by applying the polarizing treatment of FIGS. 11(A)–11(D) or FIGS. 12(A)–12(D) to a piezoelectric blank having a large area. By cutting the large piezoelectric member 10 into pieces of an appropriate size, a large number of piezoelectric members having uniform polarization characteristics (spontaneous polarization) can be obtained at one time.

Thus, according to the ultrasonic transducer and method of manufacture of the present invention as described hereinabove, electrodes or electrode contact portions and lead conductors are formed integral with the same substrate, after which the electrodes or electrode contact portions are bonded to a piezoelectric polymer member or to an electrode formed on the piezoelectric member. Accordingly, it is unnecessary to solder the electrode and leads together, so that a vibrator body can be formed without subjecting the piezoelectric member to damage caused by heat. Moreover, the electrodes and lead conductors can be connected by a single manufacturing step, and the piezoelectric member can be substantially divided into plural array vibrators or into a matrix array vibrator. The manufacturing process can be shortened as a result.

Further, in a case where electrodes of a predetermined shape are bonded to an unpolarized piezoelectric polymer member followed by polarizing the piezoelectric member through the electrodes, the electrode patterns and the array or matrix array of the piezoelectric member are inevitably in agreement. This makes it possible to form high-density array patterns or the like highly precisely. Conversely, in a case where a piezoelectric member polarized in advance is used, a large number of ultrasonic transducers having uniform characteristics can be obtained.

An ultrasonic transducer obtained as set forth above has excellent acoustic characteristics, sensitivity and response (resolution) and can be fabricated to high precision and density. Since the acoustic matching layer and adhesive bonds are uniform in thickness, the characteristics (sensitivity, pulse response) of individual vibrators in an array or matrix array are uniform, thus making it possible to obtain uniform ultrasonic tomographs over a wide field of view. Moreover, the fact that the entire transducer possesses flexibility allows the transducer to be deformed into any shape. Thus, the transducer is not limited to a linear array probe but can be changed into an arc array probe, convex array probe, and the like. Accordingly, the transducer of the present invention has wider applicability in various methods of ultrasonic tomography and can be applied to diagnose more diverse regions of a living body.

As many apparently widely different embodiments of the present invention can be made without departing from the spirit and scope thereof, it is to be understood that the invention is not limited to the specific embodiments thereof except as defined in the appended claims.

What we claim is:

1. An ultrasonic transducer comprising:

a piezoelectric member formed from a piezoelectric polymer material or a piezoelectric polymer composite and having a pair of main surfaces;

a first electrode bonded to one of the main surfaces of said piezoelectric member by an adhesive bond to cover substantially said one main surface;

a second electrode bonded to the other of the main surfaces of said piezoelectric member by an adhesive bond to cover substantially said other main surface;

a first lead conductor connected to said first electrode for leading said first electrode out to an external terminal;

a second lead conductor connected to said second electrode for leading said second electrode out to an external terminal;

a first flexible substrate with which said first electrode and said first lead conductor are both thinly integrally formed; and a second flexible substrate with which said second electrode and said second lead conductor are both thinly integrally formed;

wherein said first and second electrode comprises a plurality of electrodes, and the adhesive bond between said electrodes and said piezoelectric member comprises an adhesive possessing anisotropic electrical conductivity.

2. The ultrasonic transducer according to claim 1, wherein said second flexible substrate is formed as a part of said first flexible substrate, and said second flexible substrate is folded upon said first flexible substate with said piezoelectric member interposed therebetween.

3. The ultrasonic transducer according to claim 1, wherein said first electrode comprises a plurality of electrodes arranged in a side-by-side array, and said second electrode comprises a single electrode arranged to commonly oppose said first electrode.

4. The ultrasonic transducer according to claim 1, wherein said first and second electrodes each comprise a plurality of electrodes arranged in a side-by-side array, and said first and second electrodes are arranged to oppose each other such that the array of said first electrode is oriented perpendicular to the array of said second electrode.

5. The ultrasonic transducer according to claim 1, wherein said piezoelectric member is a polarized member.

6. The ultrasonic transducer according to claim 5, wherein said piezoelectric member is polarized at least by applying a voltage across said first and second electrode.

7. The piezoelectric transducer according to claim 5, wherein said piezoelectric member is polarized after assembly of said transducer.

8. The ultrasonic transducer according to claim 5, wherein said piezoelectric member is polarized in advance of assembly of said transducer.

* * * * *